US011808120B2

(12) United States Patent
Kennedy

(10) Patent No.: US 11,808,120 B2
(45) Date of Patent: Nov. 7, 2023

(54) GAS LIFT BARRIER

(71) Applicant: Shale Oil Tools, LLC, Rosenberg, TX (US)

(72) Inventor: Brian Kennedy, Sugar Land, TX (US)

(73) Assignee: Shale Oil Tools, LLC, Rosenberg, TX (US)

( * ) Notice: Subject to any disclaimer, the term of this patent is extended or adjusted under 35 U.S.C. 154(b) by 0 days.

(21) Appl. No.: 17/017,433

(22) Filed: Sep. 10, 2020

(65) Prior Publication Data

US 2021/0071507 A1 Mar. 11, 2021

Related U.S. Application Data

(60) Provisional application No. 62/898,694, filed on Sep. 11, 2019.

(51) Int. Cl.

| | |
|---|---|
| ***E21B 43/12*** | (2006.01) |
| ***E21B 34/06*** | (2006.01) |
| ***E21B 23/03*** | (2006.01) |

(52) U.S. Cl.

CPC ..... *E21B 43/123* (2013.01); *E21B 34/063* (2013.01); *E21B 23/03* (2013.01); *E21B 2200/08* (2020.05)

(58) Field of Classification Search

CPC .. E21B 43/123; E21B 34/063; E21B 2200/08; E21B 23/03

See application file for complete search history.

(56) References Cited

U.S. PATENT DOCUMENTS

| | | | | |
|---|---|---|---|---|
| 2,845,940 | A * | 8/1958 | Garrett | E21B 43/123 137/155 |
| 3,362,347 | A * | 1/1968 | Canalizo | E21B 43/122 417/117 |
| 6,220,357 | B1 * | 4/2001 | Carmichael | E21B 34/10 166/227 |
| 8,342,240 | B2 * | 1/2013 | Richard | E21B 43/086 166/205 |
| 10,309,192 | B2 * | 6/2019 | Techentien | E21B 43/10 |
| 2012/0211239 | A1 * | 8/2012 | Kritzler | E21B 43/122 166/372 |
| 2014/0318780 | A1 * | 10/2014 | Howard | E21B 34/06 166/285 |
| 2020/0095845 | A1 * | 3/2020 | Watkins | E21B 23/04 |

* cited by examiner

*Primary Examiner* — Jonathan Malikasim
(74) *Attorney, Agent, or Firm* — Ramey LLP

(57) ABSTRACT

A removable barrier is provided that prevents flow between an exterior of a mandrel and an interior of a mandrel. In one embodiment a dissolvable shroud surrounds the ports of the gas lift valve and temporarily prevents flow between the exterior of the gas lift valve and the interior of the mandrel. In an additional embodiment, a dissolvable plug may be placed within a portion of the gas lift valve or a portion of the lug in the mandrel to temporarily prevent flow between the exterior of the gas lift valve and the interior of the mandrel. In another embodiment, a dissolvable sleeve is placed within the mandrel to cover the port within the mandrel to temporarily prevent flow between the exterior of the gas the valve in the interior of the mandrel.

4 Claims, 9 Drawing Sheets

Prior Art

GAS LIFT BARRIER

CROSS-REFERENCE TO RELATED APPLICATIONS

This application claims priority to U.S. Provisional Patent Application Ser. No. 62/898,694 that was filed on Sep. 11, 2019.

BACKGROUND

Generally, in the life of an oil well, when the well is initially drilled the formation pressure in each of the hydrocarbon producing zones is sufficient to push the produced fluids to the surface through the production tubular. However, as the fluids are produced the formation pressure is reduced. Eventually there is no longer sufficient formation pressure to push the produced fluids to the surface.

Once the formation pressure has been reduced to the point where fluids are no longer pushed to the surface, artificial lift, in one form or another, may be used to lift those produced fluids to the surface. Typically, in a fracked shale well, the formation pressure falls relatively rapidly such that after a well has been producing fluid for about one year there is no longer sufficient formation pressure to push the produce fluids to the surface.

Generally, after produced fluids can no longer reach the surface, artificial lift is installed in the well. One form of artificial left that has been used to help push produced fluids to the surface is gas lift. In gas lift a series of mandrel's and gas lift assemblies are installed in a production tubular that is then installed within the casing of the well. Gas lift assemblies typically consist of a check valve and a gas lift valve. The gas lift valve is a pressure operated valve where high-pressure gas enters the valve and exerts sufficient pressure upon the bellows and bellows adapter to compress the bellows which in turn lifts the ball off of the seat thereby opening the valve and allowing the gas to flow through the seat, into and through the check valve, into and through a port in the mandrel, and finally into the produced fluid within the production tubular. The gas, when injected into the fluid, reduces the overall density of the fluid within the production tubular allowing the formation pressure to then push the reduced weight of fluid to the surface. Additionally, as the gas travels to the surface it tends to impart a portion of its upward velocity to the fluid thereby lifting the fluid with the gas.

Unfortunately, when a well first begins producing fluids, gas lift is not necessary. While it would be physically possible to install gas lift system into a well when the first production tubular is installed in the well prior to the well first producing, a gas lift system that is left in the well from one when a well first begins producing until gas lift is needed has a high probability of being inoperable due to solids or viscous materials becoming lodged within the moving portions of the gas lift assemblies. Additionally, operators may have concerns that a portion of the gas lift assembly may fail providing an open pathway for fluids to be diverted out of the production tubular. Therefore, well operators do not currently install the gas lift assemblies in the well as a part of the initial production tubular installation. After the production in a particular well is reduced to the point where it is no longer economically viable to operate with the initial production tubular, the well operators are forced to go through the costly and time-consuming operations of removing the initial production tubular from the well and installing a new production tubular with gas lift mandrels and gas lift assemblies in place.

Well operators are constantly looking to reduce the cost of operating any particular well. The present invention allows gas lift mandrels and gas lift assemblies to be installed as a part of the initial production tubular while protecting the moving portions of the gas lift assemblies until such time as gas lift is required to move fluids to the surface from the well.

SUMMARY

In order to protect the gas lift assemblies, it is envisioned that a shroud is installed over exterior of the gas lift valve and seals the fluid ports of a gas lift valve to prevent any fluids including gases from accessing fluid ports of the gas lift valve. At some point the shroud, or at least the portion of the shroud sealing the fluid ports of the gas lift valve, must be removed to allow fluid flow including gases through or around the shroud through the fluid ports of the gas lift valve and into the interior of the gas lift valve.

It is envisioned that the shroud is made from an erodible or dissolvable material to allow for the removal of the shroud after a certain period of time. The dissolvable material may include or incorporate dissolvable polymers such as polylactic acid or dissolvable metals such as dissolvable aluminum or dissolvable magnesium. In many instances the dissolvable material may include a barrier of non-dissolvable material to prevent dissolution of the dissolvable material until such time as the operator desires to access the gas lift assemblies. The non-dissolvable material barrier may be a substance that is impervious to wellbore fluids but dissolves readily in the presence of a specific material. In other instances, the shroud may be constructed of a dissolvable material that is non-dissolvable in the presence of the fluids in a particular wellbore while it dissolves readily in the presence of a different material. For instance, the shroud may be constructed of aluminum which in the presence of many wellbore fluids does not dissolve however when HCl is introduced into the well the aluminum and thus the shroud dissolve readily.

While it is anticipated that a check valve will be used in conjunction with each gas lift valve to form a gas lift assembly there may be instances where an additional barrier is utilized in conjunction with the check valve. In some embodiments a simple erodible or dissolvable material may be used as a plug and inserted from the interior of the gas lift mandrel into the port leading to the check valve.

The gas lift assembly is attached to the gas lift mandrel such that the gas lift assembly central bore is parallel to the central bore of the gas lift mandrel. Each gas lift mandrel has a port that provides fluid access between the interior of the mandrel and the exterior the mandrel. A lug is welded, or otherwise attached, over the port such that a passageway through the lug provides fluid access to the port in the mandrel. The lug in turn redirects the passageway by 90°, parallel to the central bore of the gas lift mandrel, the lug then provides a threaded or other connection to the check valve. Such that any fluid flows between the interior passage of the gas lift mandrel, through the port in the gas lift mandrel, through the lug where it is redirected to parallel the central bore the guest of mandrel, through the check valve, through the gas lift valve, and into the annular area between the gas lift mandrel and the wellbore wall or casing. In an embodiment of the present invention an access port would be formed within the lug where a dissolvable plug could be placed within the lug to block fluid flowing between the interior of the gas lift mandrel and the check valve. It is envisioned that the access port in the lug would utilize a dissolvable plug with a non-dissolvable plug threaded into the lug to seal external access to the passageway and holding the non-dissolvable plug in place within the lug until such time as the non-dissolvable plug dissolved or eroded away.

DETAILED DESCRIPTION

The description that follows includes exemplary apparatus, methods, techniques, or instruction sequences that embody techniques of the inventive subject matter. However, it is understood that the described embodiments may be practiced without these specific details. When referring to the top of the device or component top is towards the surface of the well. Side is radially offset from a component but minimally longitudinally offset.

Figure 1:
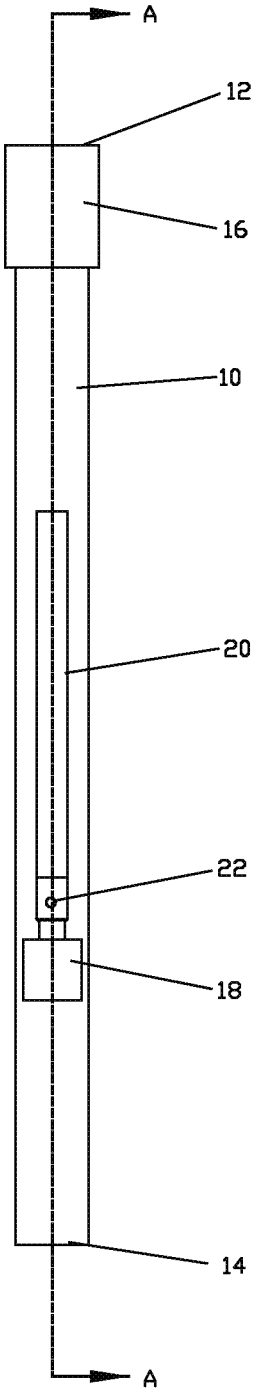
FIG. 1 depicts an external view of a gas lift mandrel where a shroud blocks the ports of the gas lift valve.

FIG. 1 depicts a prior art gas lift mandrel 10. The gas lift mandrel 10 has an upper end 12 and a lower end 14. A first coupling 16 is attached to the upper end 12 of the mandrel 10. The first coupling 16 is typically used to facilitate screwing the mandrel 10 into the production tubular (not shown) above the mandrel 10. Typically, a second coupling is attached to the lower end 14 of the mandrel 10 to the production tubular (not shown) below the mandrel 10. The mandrel 10 includes a first port 24 (FIG. 2) to provide access between the interior of the mandrel and the exterior the mandrel. In FIG. 1 the first port 24 is covered by lug 18. Lug 18 has a bore that is directed through lug 18 in order to facilitate redirecting flow to the first port 24 in the mandrel 10. A gas lift valve 20 is threaded into the lug 18 so that flow through a portion of the interior of gas lift valve 20 is directed through the first port 24 in the mandrel 10. Gas lift valve 20 includes at least one second port 22. Flow through the gas lift valve 20 is provided only through the at least one, second port 22 to the interior of the gas the valve 20, into lug 18, through the first port 24 in the mandrel 10, and then finally into the interior of the mandrel 10.

Figure 2:
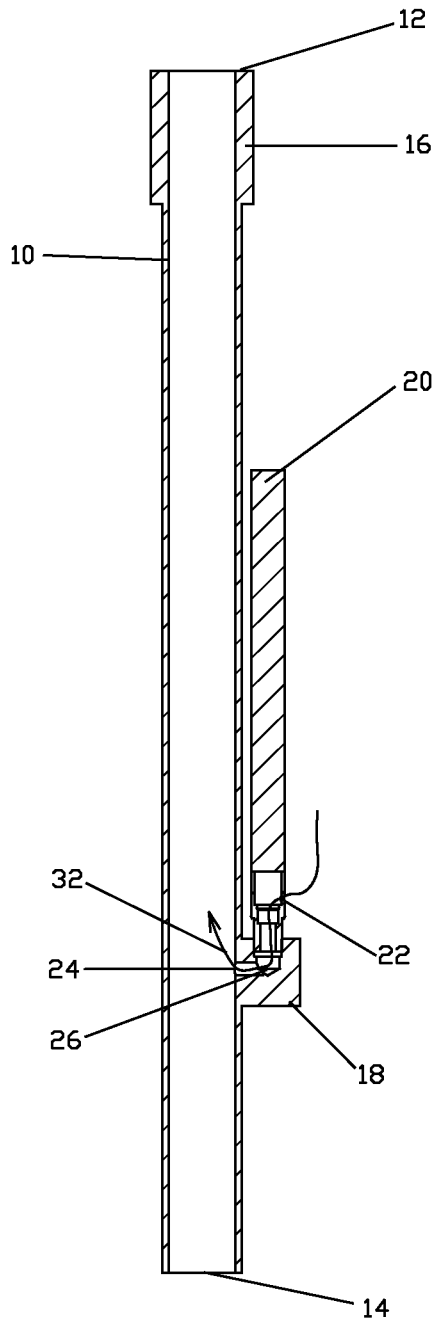
Figure 2 Prior Art
FIG. 2 depicts a cross-section along line A-A of a gas lift mandrel where a shroud blocks the ports of the gas lift valve.

FIG. 2 depicts a cross-section along line A-A of the gas lift mandrel 10 of FIG. 1. As is now shown, first port 24 in the mandrel 10 provides access between the interior of the mandrel 10 and the exterior the mandrel 10. The first port is covered by lug 18 and includes bore 26 that is directed through lug 18 in order to facilitate redirecting flow through the mandrel 10. Gas lift valve 20 is threaded into the lug 18 so that flow through a portion of the interior of gas lift valve 20 is directed through the first port in the mandrel 10. Gas lift valve 20 includes at least one second port 22. Flow through the gas lift valve 20 is depicted by arrow 30 through the at least one, second port 22 to the interior of the gas the valve 20, into lug 18, through the first port 24 in the mandrel 10, and then finally into the interior of the mandrel 10.

Figure 3:
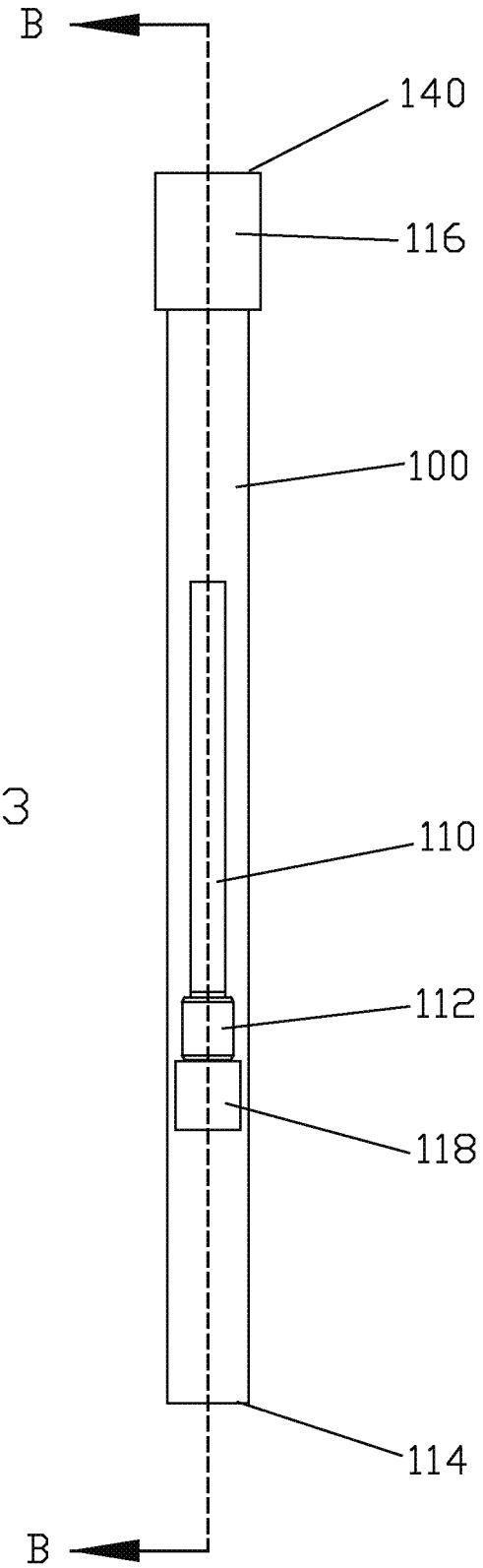
FIG. 3 depicts an external view of a gas lift mandrel where after the shroud erodes and no longer blocks the ports of the gas lift valve.
Figure 4:
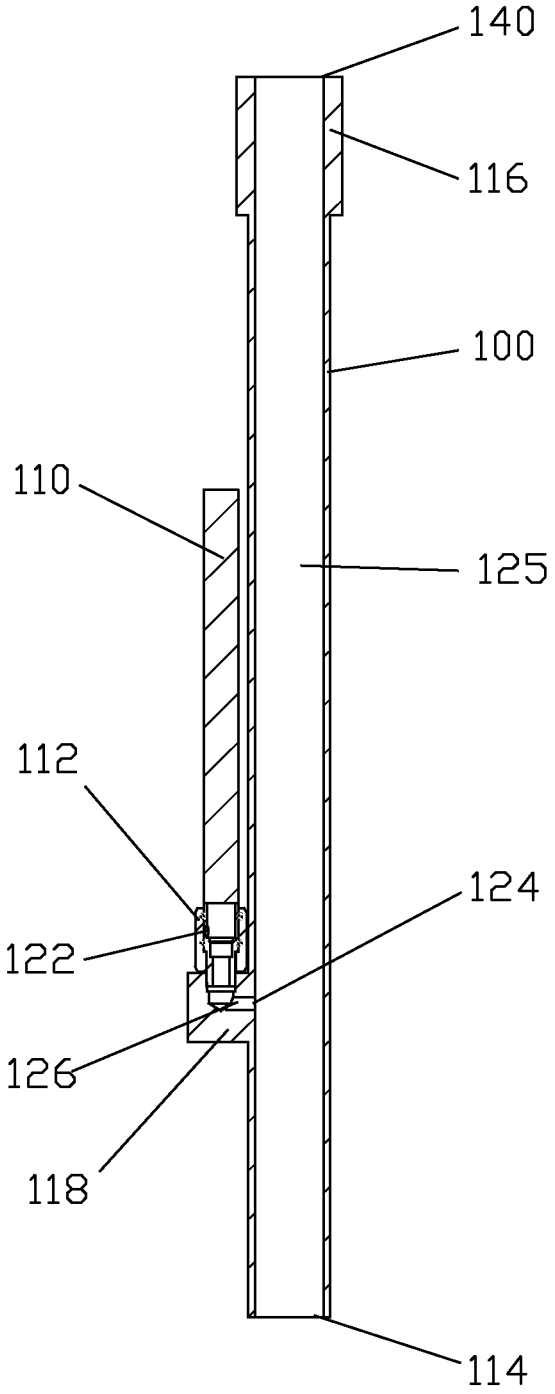
FIG. 4 depicts a cross-section along line A-A of a gas lift mandrel where after the shroud erodes and no longer blocks the ports of the gas lift valve.

FIG. 3 depicts an embodiment of the current invention wherein a gas lift mandrel 100 has a gas lift valve 110 that includes a shroud 112 blocking the at least one second port 122, in FIG. 4, of the gas lift valve 110. The gas lift mandrel 100 has an upper end 140 and a lower end 114. A first coupling 116 is attached to the upper end 140 of the mandrel 100. The first coupling 116 is typically used to facilitate attaching the mandrel 100 to the production tubular (not shown) above the mandrel 100. Typically, a second coupling is attached to the lower end 114 of the mandrel 100. The second coupling is to facilitate attaching the mandrel 100 to the production tubular (not shown) below the mandrel 100. The mandrel 100 includes a first port 124, in FIG. 4, to provide access between the interior 125 of the mandrel 100 and the exterior the mandrel 100. In FIG. 3 the first port is covered by lug 118. Lug 118 has a bore that is directed at a 90° angle through lug 118 in order to facilitate redirecting flow from the second port 122 in the gas lift valve 110 to the first port 124 in the mandrel 100. Gas lift valve 110 includes at least one second port 122. However, shroud 112 surrounds gas lift valve 110 such that all second ports 122 of gas lift valve 110 are blocked by shroud 112 such that all fluid or gas flow through all second ports 122 of gas lift valve 110 is prevented.

FIG. 4 depicts a cross-section along line B-B of the gas lift mandrel 100 from FIG. 3. As is now shown, first port 124 in the mandrel 100 provides access between the interior of the mandrel 100 and the exterior the mandrel 100. The first port 124 is covered by lug 118 and includes bore 126 that is directed through a 90° angle within lug 118 in order to facilitate redirecting flow between the exterior of the mandrel 100 and the interior 125 of the mandrel 100. Gas lift valve 110 includes at least one second port 122. However, shroud 112 is placed such that shroud 112 blocks all flow through the second ports 122 and thereby preventing flow between the interior of mandrel 100 and the exterior of mandrel 100.

Figure 5:
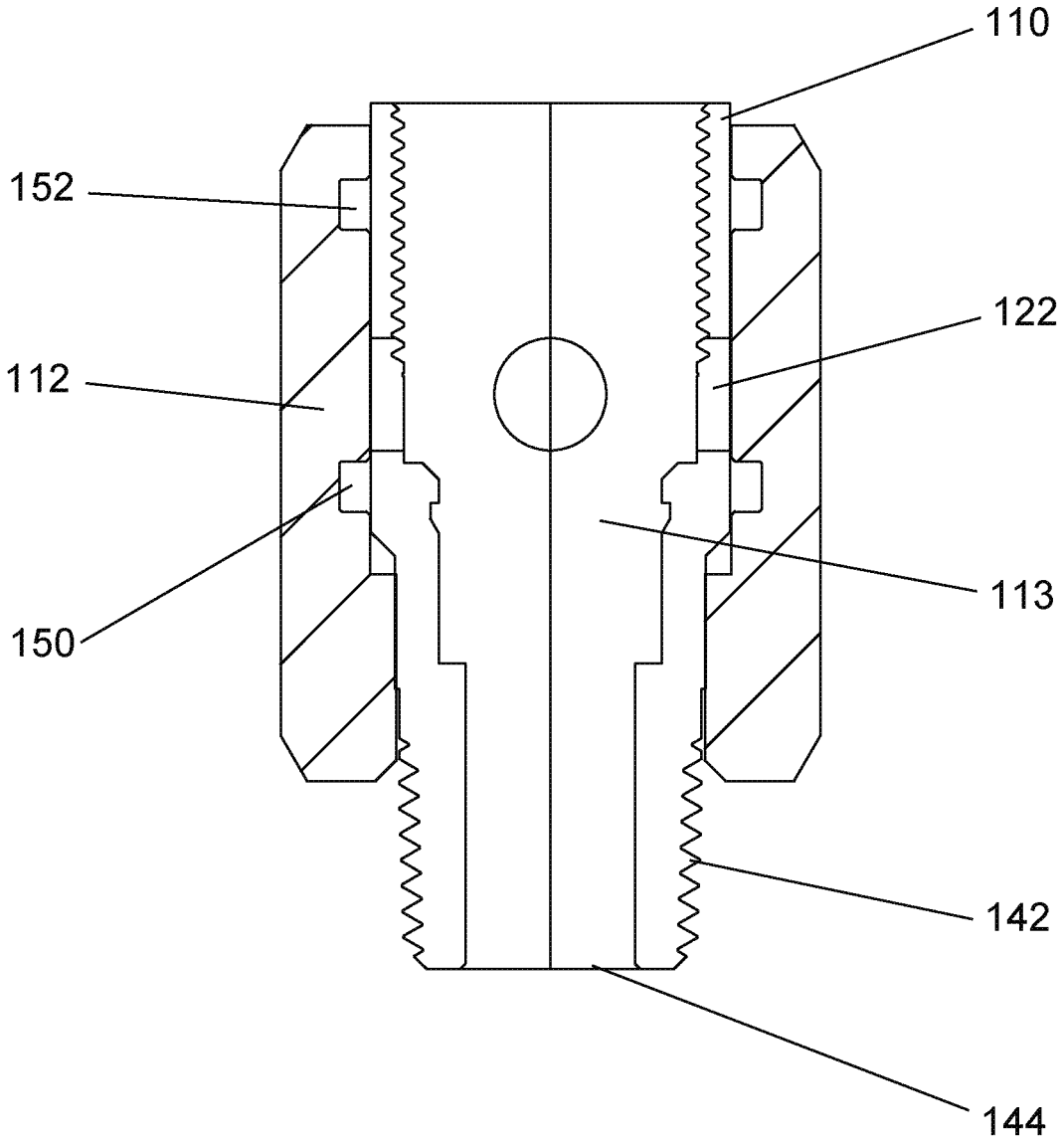
FIG. 5 is a close-up of the gas lift valve and shroud from the cross-section of FIG. 4.

FIG. 5 is a close-up of the gas lift valve 110 and shroud 112 from the cross-section of FIG. 4. The gas lift valve 110 has an externally threaded section 142 on its lower end. The externally threaded section 142 connects to lug 118. The gas lift valve 110 has an opening 144 allowing fluid or gas flow access into the interior 113 of gas lift valve 110 and provides access to the bore 126 of lug 118. The gas lift valve 110 includes second port 122 that provides access between the interior 113 of gas lift valve 110 and the exterior of mandrel 100 from FIG. 4. The shroud 112 circumferentially surrounds a portion of the gas lift valve 110, in particular the shroud 112 will cover ports 122. Typically, shroud 112 has a first seal 150 and a second seal 152. Typically, seals 150 and 152 will incorporate an O-ring so that the first O-ring 150 sits below port 122 and the second O ring 152 is above port 122. The second ports 122, the interior 113 of gas lift valve 112, the bore 126 of lug 118, and first port 124 provide access between the interior 125 of mandrel 100 and the exterior of mandrel 100. Together the first O-ring 150, the second O ring 152, and the shroud 112 block flow through port 122.

Figure 6:
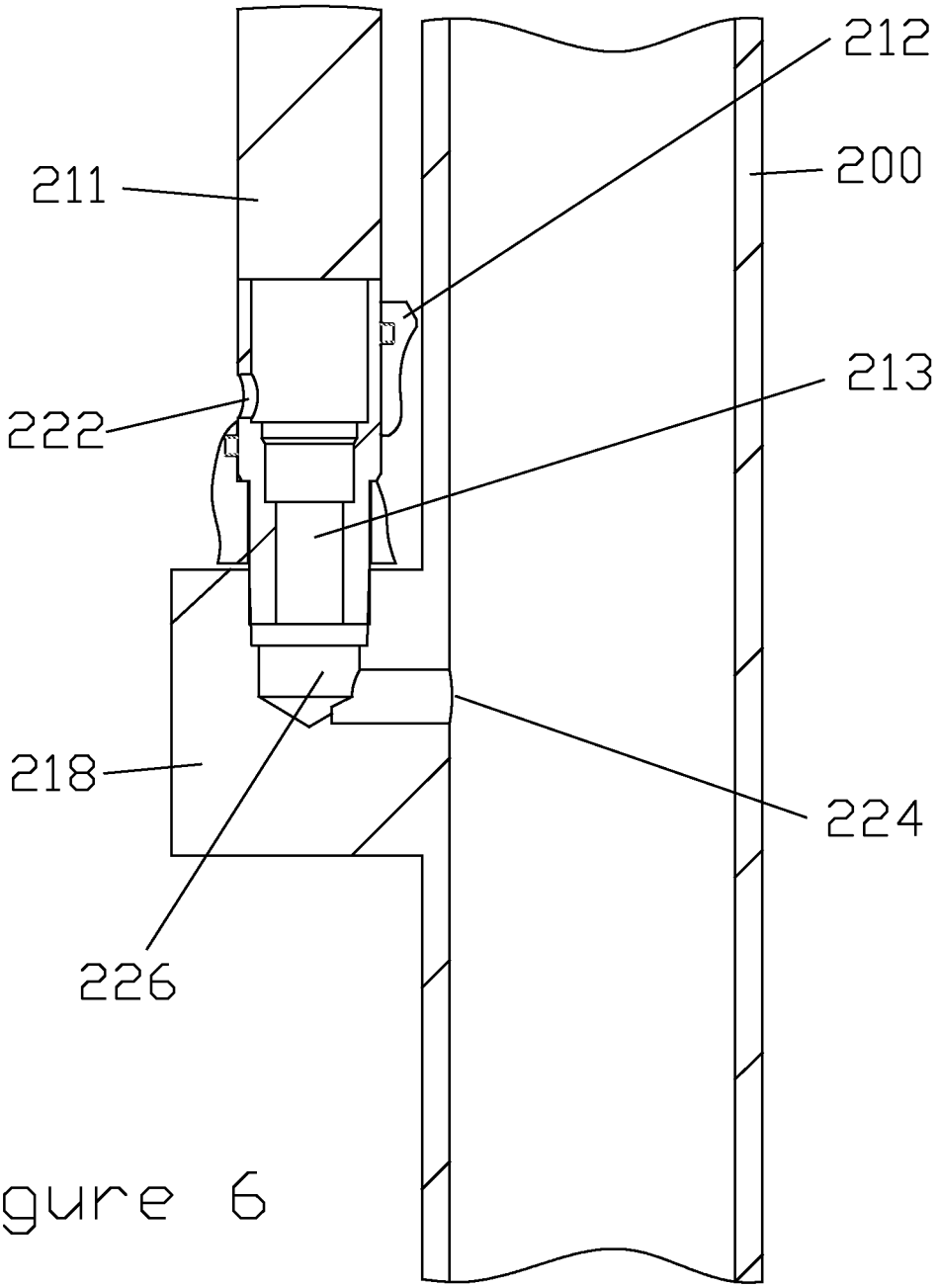
FIG. 6 is a cross-section of a portion of a mandrel having a gas lift valve attached to a lug.

FIG. 6 is a cross-section of a portion of a mandrel 200 having a gas lift valve 212 attached to a lug 218. As shown in FIG. 6 the shroud 212 is at least partially dissolved or eroded so that port 222 is no longer blocked by shroud 212. With shroud 212 eroded or dissolved a flowpath is now open between the interior of the mandrel 200 through port 224, through bore 226 of the lug 218, into the interior 213 of the gas lift valve 212, through port 222, and finally to the exterior of the mandrel 200. It is generally envisioned that shroud 212 is constructed of a dissolvable magnesium where depending upon the media and temperature into which the shroud 212 is placed the dissolvable magnesium will disintegrate or dissolve at a known rate. The dissolvable material allows the gas lift valve and mandrel to be placed within the well where the gas lift valve is initially inoperable due to the obstruction formed by shroud 212 over ports 224. However after some period of time the shroud will dissolve and allowing the gas lift system to be accessed and operated. While the preferred dissolvable material is dissolvable magnesium any dissolvable material having sufficient structural strength to withstand pressures exerted by the fluid against shroud 212 may be utilized.

Figure 7:
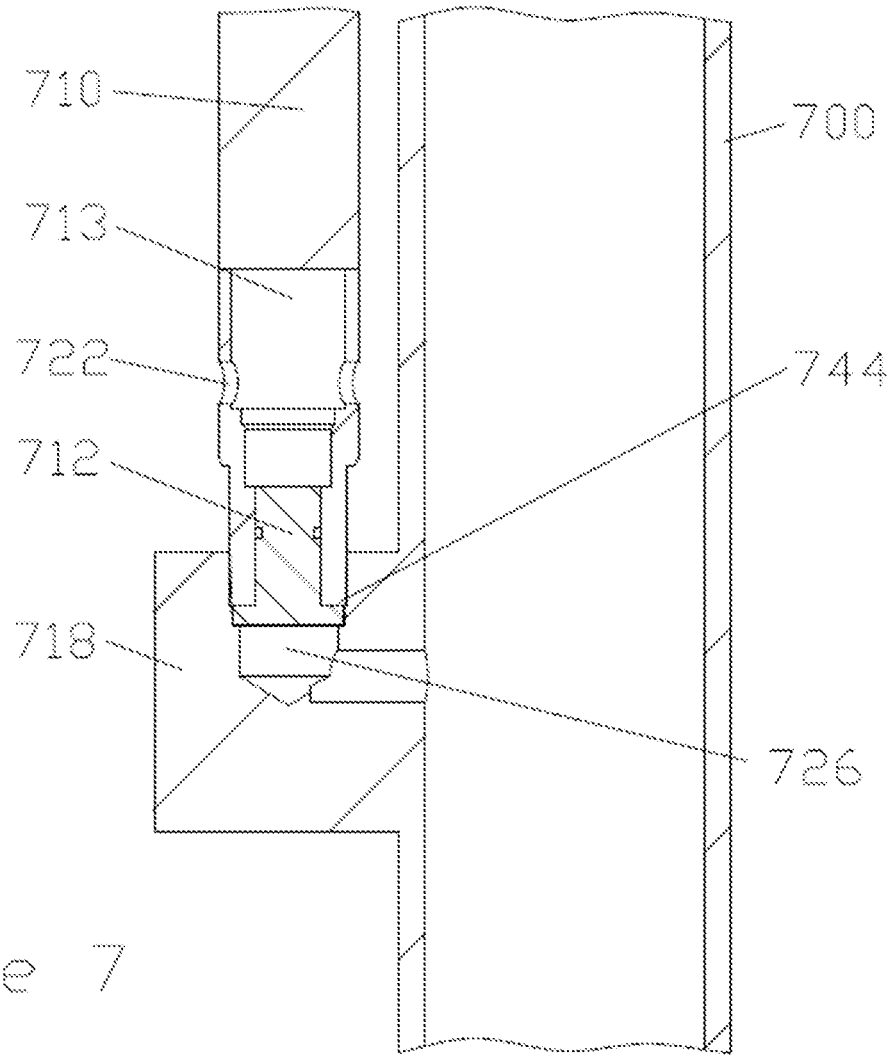
FIG. 7 is a view of a portion of a gas lift valve, a portion of a mandrel, and a plug.

FIG. 7 is a view of a portion of a gas lift valve 710, a portion of a mandrel 700, and a plug 712. The gas lift valve 712 has an opening 744 to allow fluid or gas flow access into the interior 713 of gas lift valve 712 that connects with the bore 726 of lug 718. The gas lift valve 712 also includes second port 722 to provide access between the interior 713 of the gas lift valve 710 and the exterior of the mandrel 700. The plug 712 is placed within the interior 713 of gas lift valve 710 via opening 744 and blocks fluid or gas flow through the interior of 713 of the gas lift valve 710. The plug 712 is a dissolvable material, preferably dissolvable magnesium.

Figure 8:
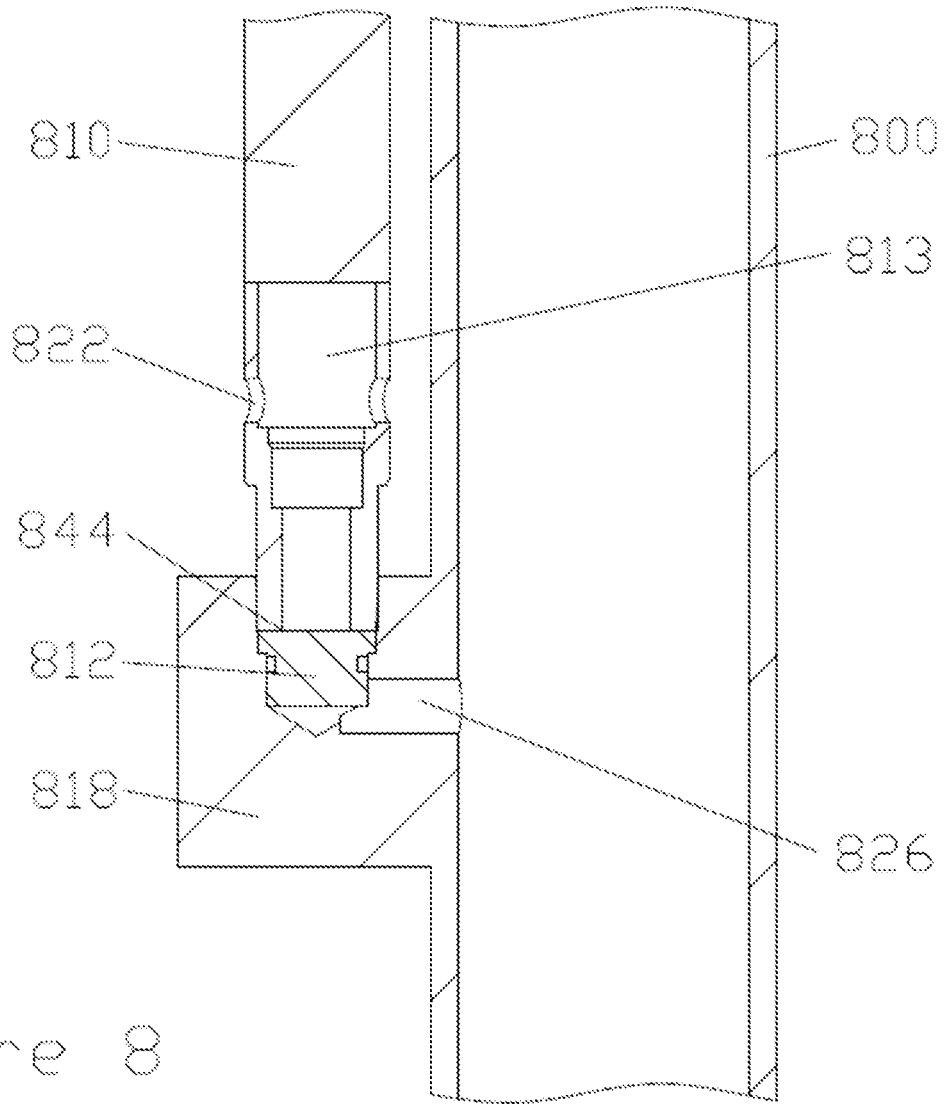
FIG. 8 is a view of a portion of a gas lift valve, a portion of a mandrel, and a mandrel plug.

FIG. 8 is a view of a portion of a gas lift valve 810, a portion of a mandrel 800, and a mandrel plug 812. The gas lift valve 810 has an opening 844 to allow fluid or gas flow access into the interior 813 of gas lift valve 812 that connects with the bore 826 of lug 818. The gas lift valve 812 also includes second port 822 to provide access between the interior 813 of the gas lift valve 810 and the exterior of the mandrel 800. The mandrel plug 812 is placed within the bore 826 of lug 818 and blocks fluid or gas flow between the interior of 813 of the gas lift valve 810 and the interior of the mandrel 800. The mandrel plug 812 is a dissolvable material, preferably dissolvable magnesium.

Figure 9:
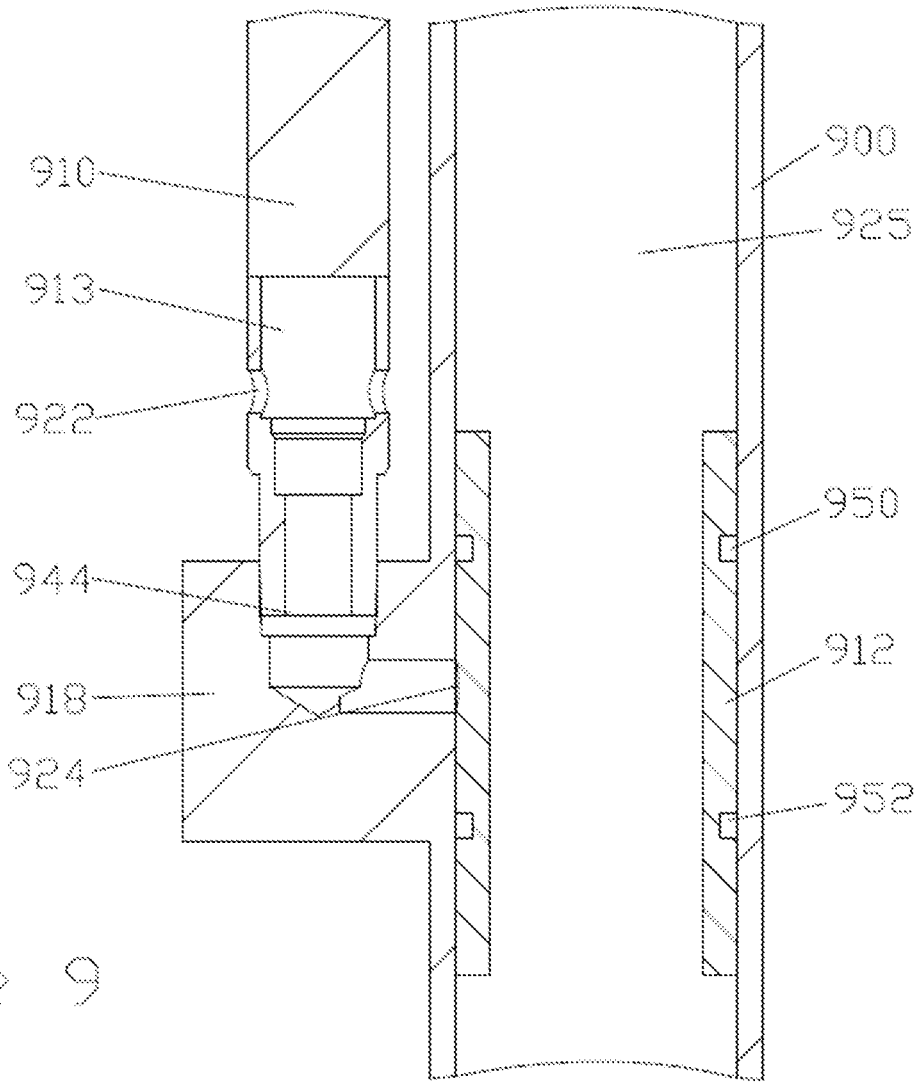
FIG. 9 is a view of a portion of a gas lift valve, a portion of a mandrel, and a sleeve.

FIG. 9 is a view of a portion of a gas lift valve 910, a portion of a mandrel 900, and a sleeve 912. The gas lift valve 912 has an opening 944 to allow fluid or gas flow access into the interior 913 of gas lift valve 912 that connects with the bore 926 of lug 918. Bore 926 provides access between the interior 925 of mandrel 900 via first port 924 and the interior 913 of the gas lift valve 910. The gas lift valve 912 also includes second port 922 to provide access between the interior 913 of the gas lift valve 910 and the exterior of the mandrel 900. The sleeve 912 may include a first o-ring 950 and a second o-ring 952. The sleeve 912 is placed within the interior 925 of mandrel 900 such that the first o-ring 950 is above the first port 924 and the second o-ring 952 is below the first port 924 where in cooperation with sleeve 912, which is placed adjacent to the first port 924, blocks fluid or gas flow between the interior of 913 of the gas lift valve 910 and the interior 925 of the mandrel 900. The sleeve 912 is a dissolvable material, preferably dissolvable magnesium.

The nomenclature of leading, trailing, forward, rear, clockwise, counterclockwise, right hand, left hand, upwards, and downwards are meant only to help describe aspects of the tool that interact with other portions of the tool.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A gas lift system comprising:

a mandrel having a first port and a lug, wherein the lug has a bore, a gas lift valve having a second port, wherein the first port, the bore, the gas lift valve, and the second port provide a flow path between an exterior of the mandrel and an interior of the mandrel, a dissolvable shroud having a first o-ring, a second o-ring, and sufficient structural strength to withstand pressure exerted by a fluid against the shroud, and a throughbore, wherein the dissolvable shroud is placed upon the gas lift valve such that the gas lift valve extends into the throughbore of the dissolvable shroud such that the first o-ring, the second o-ring, and the shroud block the flowpath through the second port.

2. The gas lift system of claim 1 wherein, the shroud is dissolvable aluminum.

3. The gas lift system of claim 1 wherein, the shroud is dissolvable magnesium.

4. The gas lift system of claim 1 wherein, the shroud is polylactic acid.

* * * * *